US010927636B2

(12) United States Patent
Prasad et al.

(10) Patent No.: US 10,927,636 B2
(45) Date of Patent: Feb. 23, 2021

(54) ANNULAR BARRIER WITH VALVE UNIT

(71) Applicant: WELLTEC OILFIELD SOLUTIONS AG, Zug (CH)

(72) Inventors: Bala Prasad, Zug (CH); Ricardo Reves Vasques, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 16/701,961

(22) Filed: Dec. 3, 2019

(65) Prior Publication Data

US 2020/0173245 A1 Jun. 4, 2020

(30) Foreign Application Priority Data

Dec. 4, 2018 (EP) ..... 18210212

(51) Int. Cl.
*E21B 23/04* (2006.01)
*E21B 23/06* (2006.01)
(Continued)

(52) U.S. Cl.
CPC ..... *E21B 33/128* (2013.01); *E21B 23/04* (2013.01); *E21B 23/06* (2013.01); *E21B 34/101* (2013.01); *E21B 34/103* (2013.01)

(58) Field of Classification Search
CPC ..... E21B 23/0421; E21B 23/04; E21B 23/06; E21B 33/127
See application file for complete search history.

(56) References Cited

U.S. PATENT DOCUMENTS 3,818,922 A * 6/1974 Malone ..... E21B 33/127 137/70
4,260,164 A * 4/1981 Baker ..... E21B 33/127 137/461
2017/0211347 A1 7/2017 Vasques

FOREIGN PATENT DOCUMENTS

EP 0 214 851 3/1987
EP 3 327 246 5/2018

OTHER PUBLICATIONS

Extended European Search Report for EP Application No. 18210212.9 dated May 16, 2019, 7 pages.

* cited by examiner

*Primary Examiner* — Cathleen R Hutchins
(74) *Attorney, Agent, or Firm* — Nixon & Vanderhye P.C.

(57) ABSTRACT

The present invention relates to an annular barrier to be expanded in an annulus between a well tubular metal structure and a wall of a borehole or another well tubular metal structure in a well in order to provide zone isolation between a first zone having a first pressure and a second zone having a second pressure of the borehole, the annular barrier comprising a tubular metal part adapted to be mounted as part of the well tubular metal structure, an expandable metal sleeve surrounding the tubular metal part, each end of the expandable metal sleeve being connected with the tubular metal part defining an annular space between the expandable metal sleeve and the tubular metal part. The annular barrier further comprises a valve unit having an initial position and an end position, the valve unit comprising a first aperture in fluid communication with the inside, a second aperture in fluid communication with the annular space, a third aperture in fluid communication with the annulus. The invention also relates to a downhole system comprising a well tubular metal structure and an annular (Continued)

Figure 1:
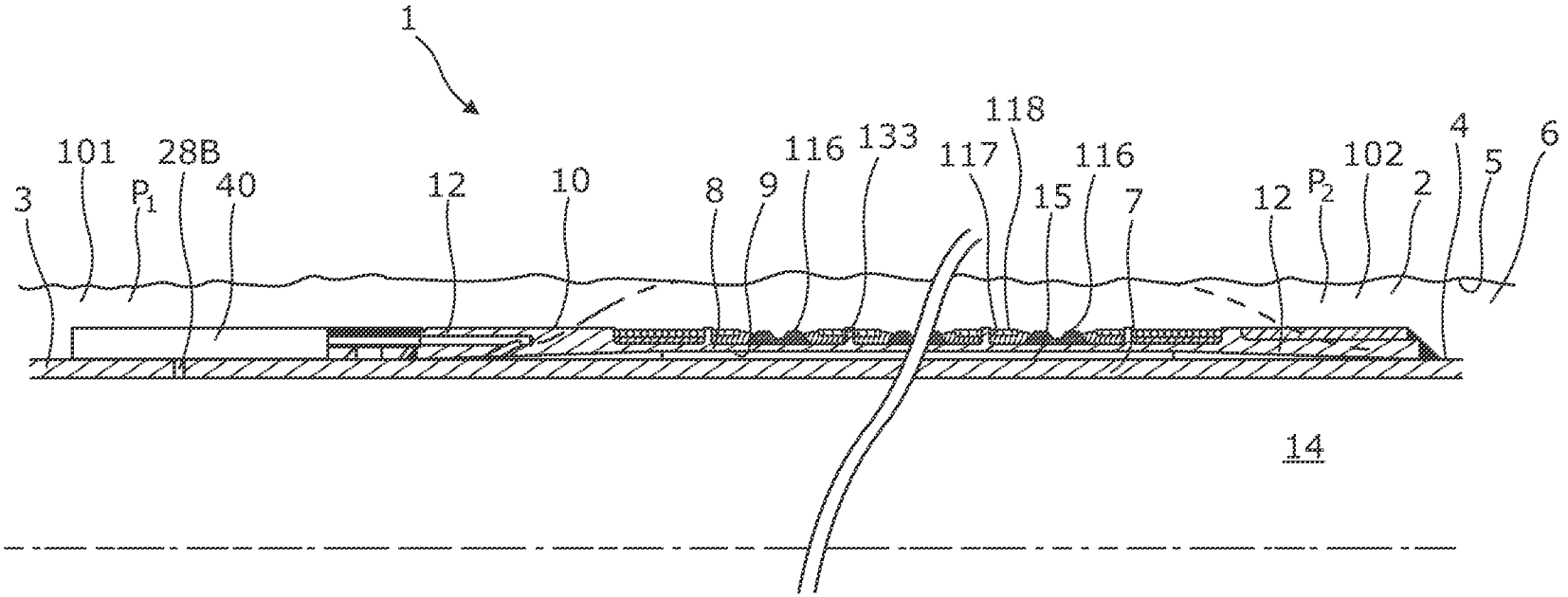

barrier in which the tubular metal part of the annular barrier is mounted as part of the well tubular well tubular metal structure.

14 Claims, 7 Drawing Sheets

(51) Int. Cl.

| | |
|---|---|
| ***E21B 33/127*** | (2006.01) |
| ***E21B 33/128*** | (2006.01) |
| ***E21B 34/10*** | (2006.01) |

ANNULAR BARRIER WITH VALVE UNIT

This application claims priority to European Patent Application No. 18210212.9 filed Dec. 4, 2018, the entire contents of which are hereby incorporated by reference.

The present invention relates to an annular barrier to be expanded in an annulus between a well tubular metal structure and a wall of a borehole or another well tubular metal structure in a well in order to provide zone isolation between a first zone having a first pressure and a second zone having a second pressure of the borehole. The invention also relates to a downhole system.

In wellbores, an annular barrier such as a Swell Packer, a SWELLPACKER, a STEELSEAL or a ZONESEAL is used for providing a zonal isolation of the annulus between the casing and the wall of another casing or the wall of the borehole, or for providing a liner hanger.

When expanding annular barriers having an expandable metal sleeve, the sleeve is expanded from a first diameter to a second larger diameter by pressurising an annular space between the expandable metal sleeve and the base pipe. In some known barriers, the fluid communication into the annular space is closed while running the annular barrier mounted on the well tubular metal structure into the borehole, and in order to expand the expandable metal sleeve a shear disc needs to be sheared before the fluid communication to the annular space is provided and expansion can begin. In this way, premature and unintended expansion is avoided while running the annular barrier into the borehole.

Premature expansion of the annular barrier is known from Swell Packer, SWELLPACKER or similar ZONESEAL where during running of the annular barrier in hole may cause the well tubular metal structure to be stuck before being arranged in the intended position. In other known barriers, use of such shear discs is avoided since there is a great risk in high pressure wells that the expandable metal sleeve will be pushed radially inwards in a collapsed position in which later intended expansion of the expandable metal sleeve in order to set the annular barrier cannot be completed since due to the collapsed expandable metal sleeve, the pressure needed for expanding the expandable metal sleeve is substantially increased beyond the pressure allowed for that completion or the sleeve is weakened and cannot be expanded as much as needed causing the sleeve to break during expansion.

It is an object of the present invention to wholly or partly overcome the above disadvantages and drawbacks of the prior art. More specifically, it is an object to provide an improved annular barrier which can be expanded in high pressure wells without expanding prematurely.

The above objects, together with numerous other objects, advantages and features, which will become evident from the below description, are accomplished by a solution in accordance with the present invention by a downhole annular barrier to be expanded in an annulus between a well tubular metal structure and a wall of a borehole or another well tubular metal structure in a well in order to provide zone isolation between a first zone having a first pressure and a second zone having a second pressure of the borehole, the annular barrier comprising:

a tubular metal part adapted to be mounted as part of the well metal tubular structure, the tubular metal part having an outer face and an inside, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, wherein the annular barrier further comprises a valve unit having an initial position and an end position, the valve unit comprising:

a first aperture in fluid communication with the inside, a second aperture in fluid communication with the annular space, a third aperture in fluid communication with the annulus, a unit bore having a bore extension and comprising a first bore part having a first inner diameter and a second bore part having an inner diameter, which is larger than that of the first bore part, the first aperture is arranged in the second bore part, and the second aperture and the third aperture are arranged in the first bore part and displaced along the bore extension, a unit piston arranged in the unit bore, the unit piston comprising a first piston part, which is arranged in the first bore part in the initial position and has an outer diameter substantially corresponding to the inner diameter of the first bore part, and the unit piston comprises a second piston part, which is arranged in the second bore part in the initial position and has an outer diameter substantially corresponding to the inner diameter of the second bore part, and a shear pin preventing movement of the unit piston until a predetermined pressure in the bore is reached and the unit piston is allowed to move to the end position providing fluid communication between the first aperture and the second aperture, and wherein the second aperture is in fluid communication with the third aperture in the initial position so that pressure equalisation between the annular space and the annulus occurs while running the annular barrier into the well.

Moreover, the valve unit may further comprise a spring configured to be compressed after breaking the shear pin by pressure acting on the second piston part so that when releasing the pressure, the compressed spring forces the unit piston to the end position.

Also, it may hereby be obtained that the pressure needs to be released to move the unit piston to the end position and thus, the high pressure built up in order to be able to shear, the shear pin not being directly transferred to the space of the annular barrier as a shock pressure. Hereby, it is ensured that the annular barrier is expanded by a substantially continuously increasing pressure.

Furthermore, the spring may be arranged in a third bore part having a larger inner diameter than the inner diameter of the second bore part.

In addition, the unit piston may have a third piston part arranged in the third bore part, having an outer diameter larger than the second piston part.

Further, the third piston part may correspond to the outer diameter of the spring.

Additionally, the unit piston may have an intermediate part in between the first piston part, the second piston part and the intermediate part having an outer diameter being smaller than that of both the piston part and the second piston part.

Moreover, the valve unit may further comprise a locking element adapted to mechanically lock the unit piston when the unit piston is in the end position, blocking the third aperture.

Furthermore, the locking element may be configured to move at least partly radially outwards or inwards upon movement of the unit piston away from the initial position to prevent the piston from returning to the initial position of the unit piston.

Also, the locking element may be arranged between the second piston part and the third piston part.

In addition, the locking element may permanently lock the piston in a closed position.

Further, the unit piston may have a first piston face at a first piston end at the first piston part and a second piston face at the second piston part, the second piston face having a face area, which is larger than a face area of the first piston face in order to move the unit piston towards the first bore end.

Additionally, the downhole annular barrier may further comprise a shear pin assembly having a first opening in fluid communication with the second aperture of the valve unit and a second opening in fluid communication with the annular space of the annular barrier and third opening in fluid communication with the annulus, the shear pin assembly having a first position in which expansion fluid from the second aperture of the valve unit is allowed to flow into the annular space, and a second position in which fluid connection to the second aperture is being blocked preventing expansion fluid from entering the space.

Moreover, the shear pin assembly may have a bore, having a bore extension and comprising a first bore part, having a first inner diameter and a second bore part having an inner diameter, which is larger than that of the first bore part.

Further, the first opening and the second opening may be arranged in the first bore part and displaced along the bore extension, the shear pin assembly further comprising an assembly piston arranged in the bore, the assembly piston comprising a first piston part having an outer diameter substantially corresponding to the inner diameter of the first bore part and comprising a second piston part having an outer diameter substantially corresponding to the inner diameter of the second bore part, and a rupture element preventing movement of the assembly piston until a predetermined pressure in the bore is reached.

In addition, the shear pin assembly may further comprise a locking element adapted to mechanically lock the assembly piston when the assembly piston is in the closed position blocking the first opening.

Furthermore, the locking element may be configured to move at least partly radially outwards or inwards upon movement of the assembly piston away from the initial position to prevent the assembly piston from returning to an initial position of the piston.

Additionally, the locking element may permanently lock the assembly piston in a closed position.

Also, the assembly piston may comprise a fluid channel being a through-bore providing fluid communication between the first and second bore parts.

Moreover, the assembly piston may have a centre axis arranged in a wall of the tubular metal part or in a wall of a connection part connecting the expandable metal sleeve with the tubular metal part.

Further, the assembly piston may have an initial position in which the first opening is in fluid communication with the second opening and a closed position in which the second opening is in fluid communication with the third opening in order to equalise the pressure between the annular space and the annulus.

In addition, the rupture element may be a shear pin engaging the assembly piston.

Furthermore, the rupture element may be a shear disc arranged in the fluid channel or the first bore part for preventing flow past the disc.

Additionally, the assembly piston may have a first piston end at the first piston part and a second piston end at the second piston part, the first piston end having a first piston face and the second piston end having a second piston face, the second piston face having a face area, which is larger than a face area of the first piston face in order to move the assembly piston towards the first bore end.

Moreover, the first piston part may extend partly into the second bore part in an initial position of the piston and form an annular space between the piston and an inner wall of the bore.

Also, the downhole annular barrier may further comprise an anti-collapsing unit comprising an element movable between a first unit position and a second unit position, the anti-collapsing unit having a first inlet, which is in fluid communication with the first zone, and a second inlet, which is in fluid communication with the second zone, and the anti-collapsing unit having an outlet, which is in fluid communication with the annular space through the shear pin assembly when the assembly piston is in the closed position, blocking the first opening.

In addition, the first inlet may be in fluid communication with the outlet for equalising the first pressure of the first zone with the annular space in the first unit position, and in the second unit position the second inlet being in fluid communication with the outlet for equalising the second pressure of the second zone with the space pressure.

Finally, the present invention relates to a downhole system comprising a well tubular metal structure and an annular barrier in which the tubular metal part of the annular barrier is mounted as part of the well tubular well tubular metal structure.

Figure 2A:
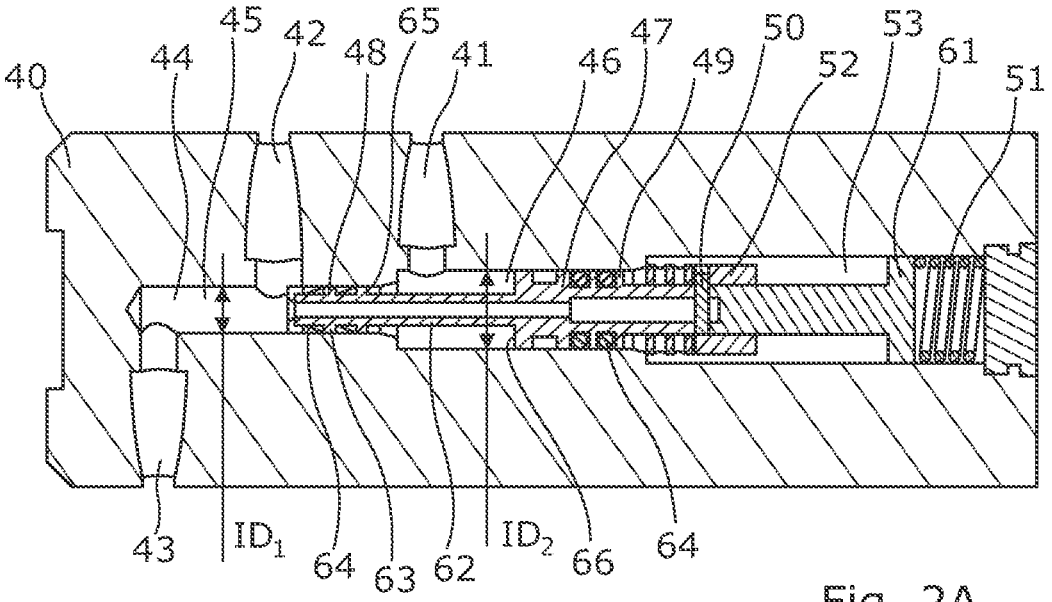
Figure 2B:
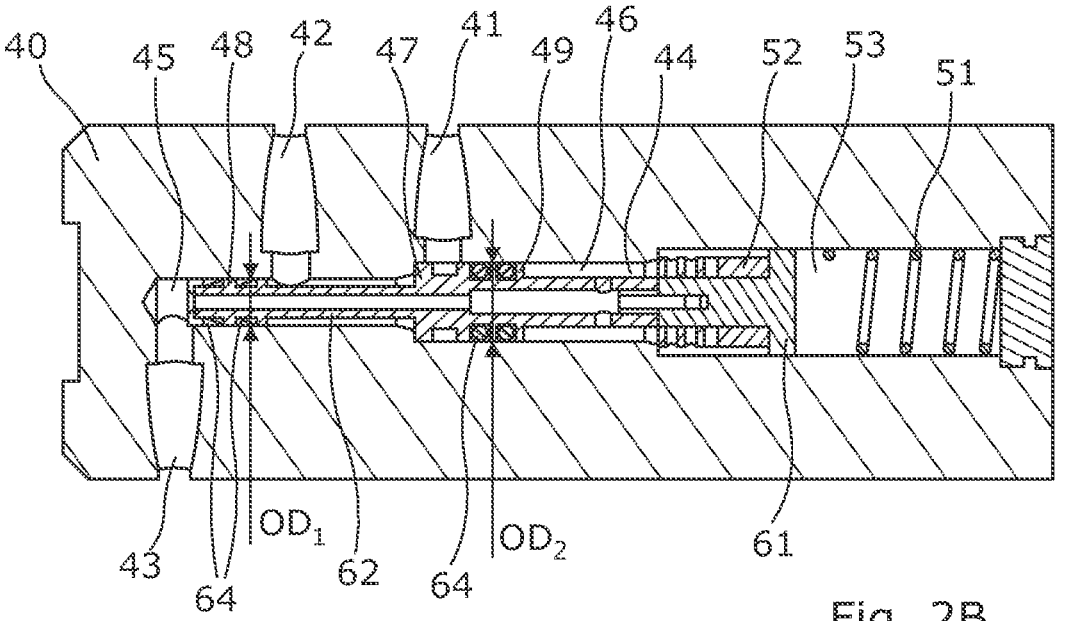
Figure 3:
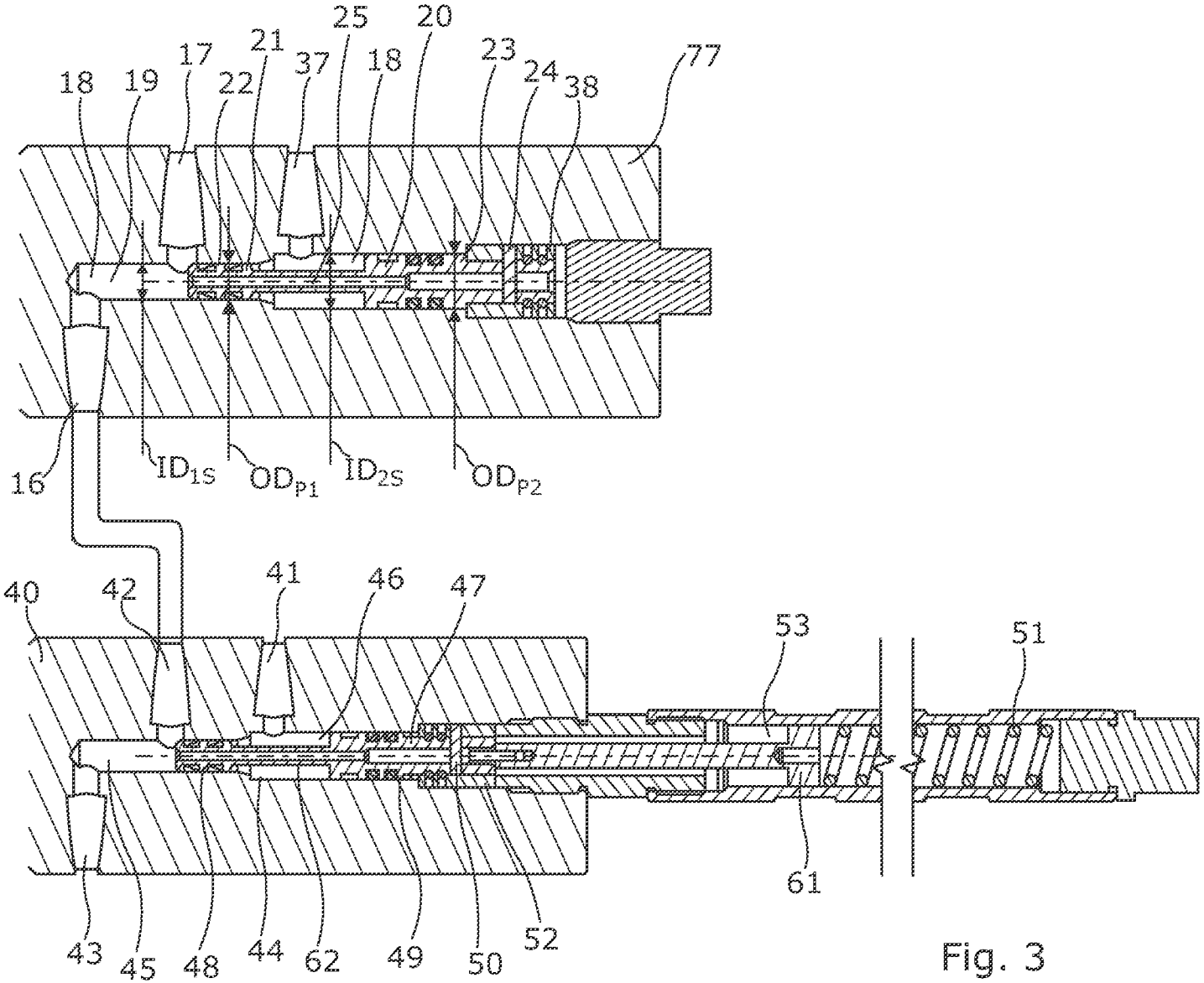
Figure 4:
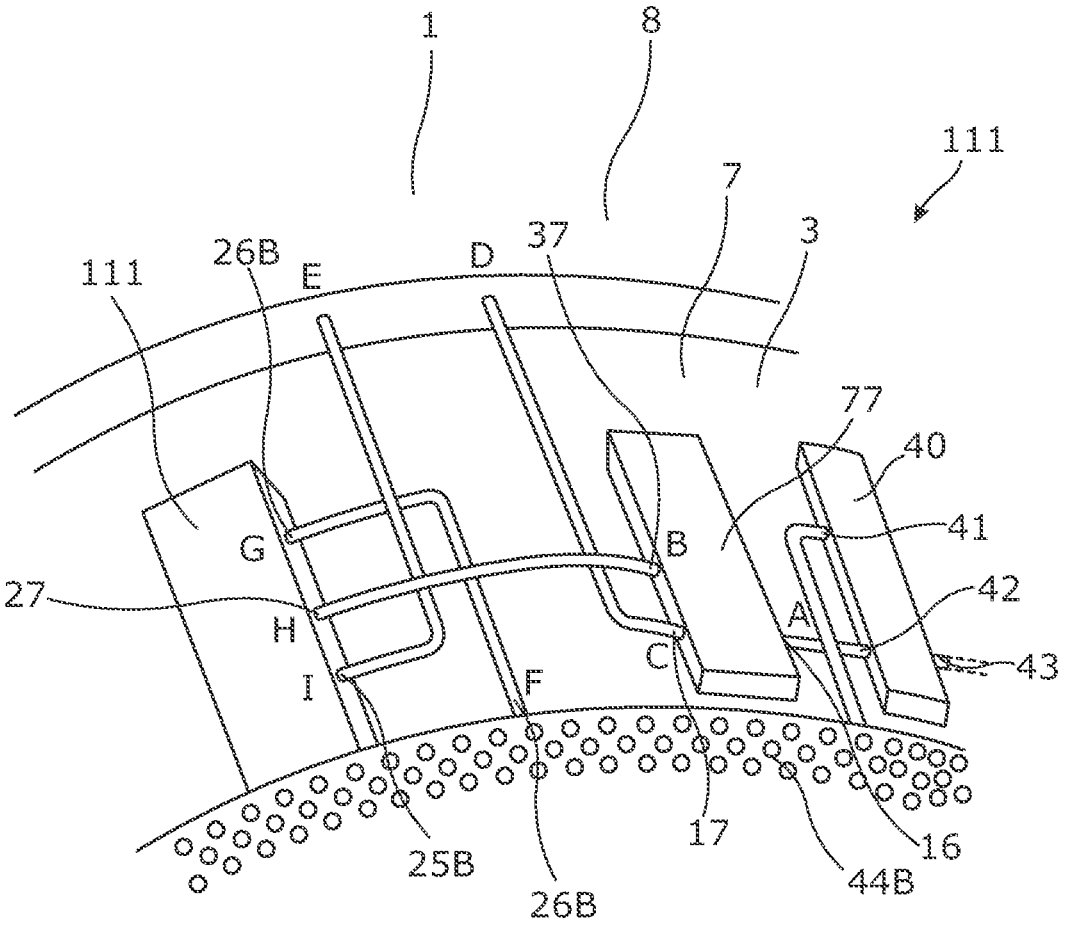
Figure 5A:
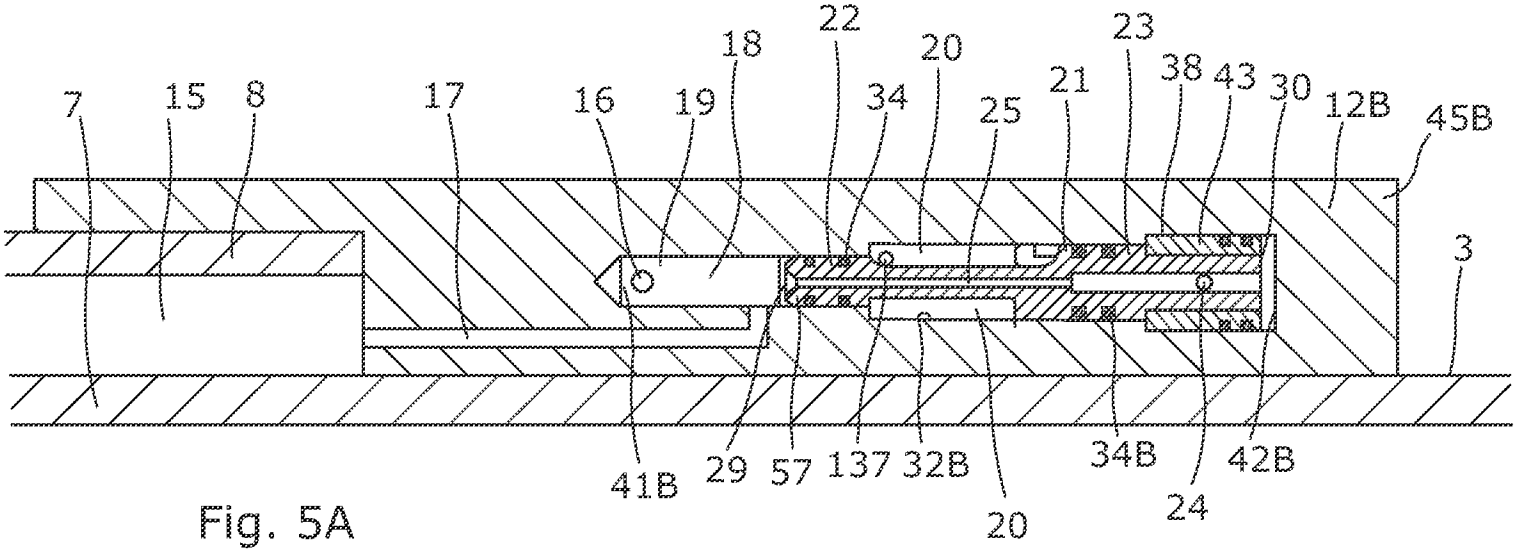
Figure 5B:
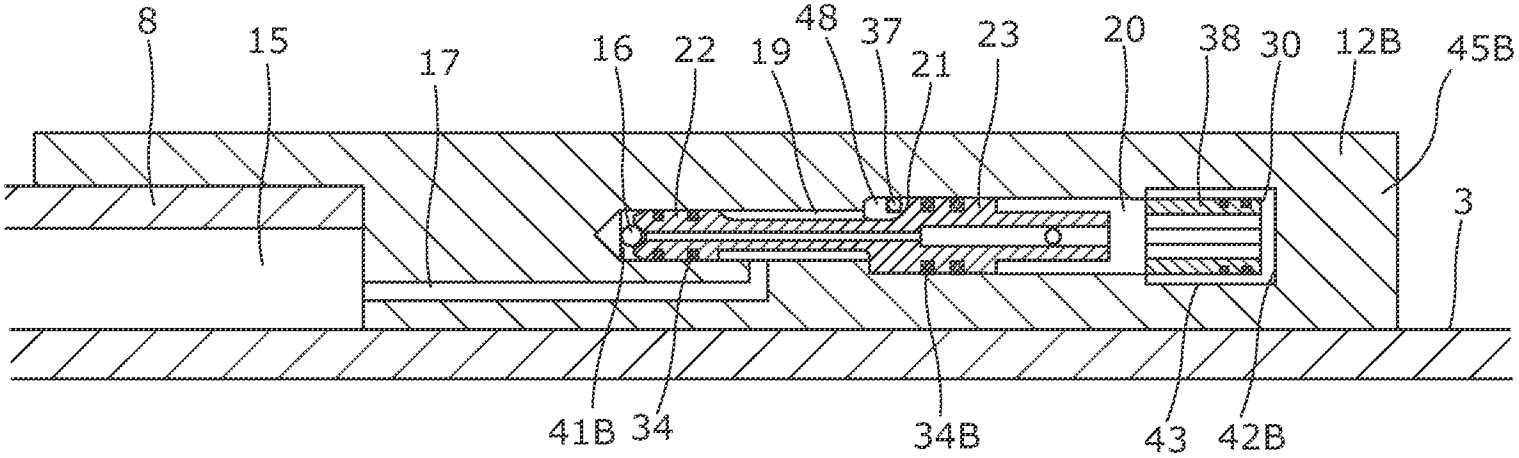
Figure 6:
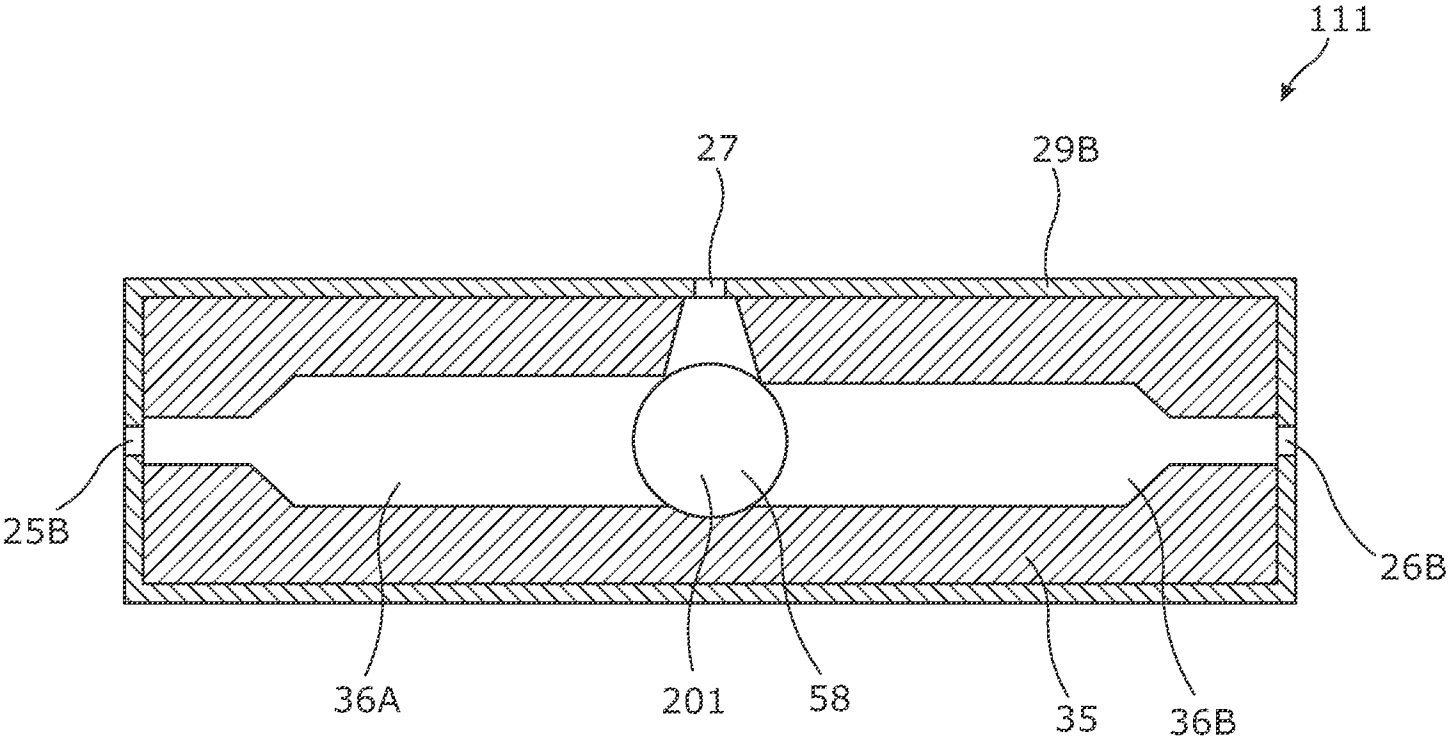
Figure 7:
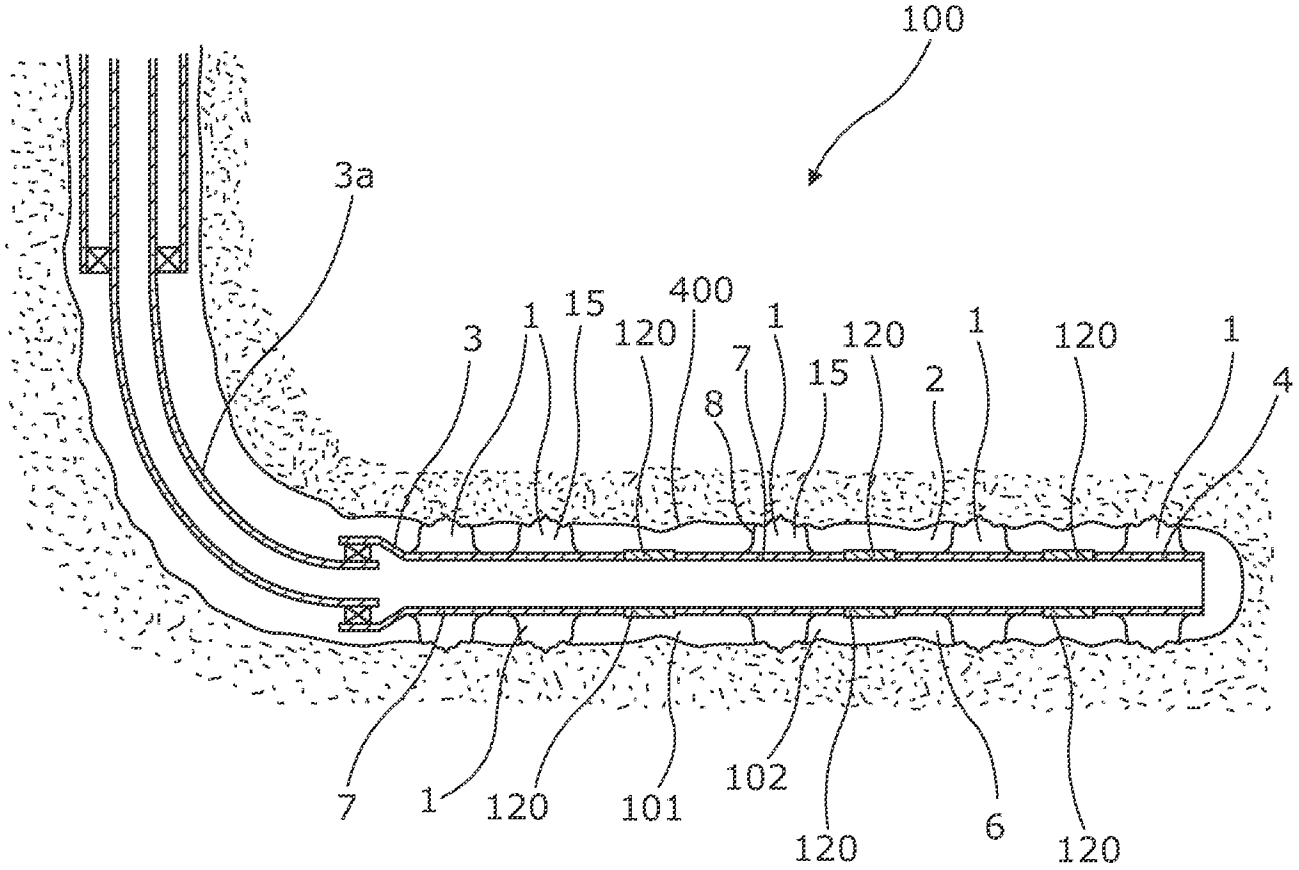

The invention and its many advantages will be described in more detail below with reference to the accompanying schematic drawings, which for the purpose of illustration show some non-limiting embodiments and in which:

FIG. 1 shows a cross-sectional view of an annular barrier mounted as part of a well tubular metal structure and having a valve unit for preventing pre-collapse of the expandable metal sleeve while running the annular barrier and the well tubular metal structure in hole, FIG. 2A shows a cross-sectional view of a valve unit in its initial position, FIG. 2B shows a cross-sectional view of the valve unit of FIG. 2A in its end position, FIG. 3 shows a cross-sectional view of a valve unit in fluid communication with a shear pin assembly, FIG. 4 shows a perspective of part of an annular barrier having a valve unit, a shear pin assembly and an anti-collapsing unit, FIGS. 5A and 5B show a cross-sectional view of part of another annular barrier having a shear pin assembly, the shear pin assembly is shown in a first position in FIG. 5A, and in its second closed position in FIG. 5B, FIG. 6 shows a cross-sectional view of an anti-collapse unit, and FIG. 7 shows a cross-sectional view of a downhole system having several annular barriers.

All the figures are highly schematic and not necessarily to scale, and they show only those parts, which are necessary in order to elucidate the invention, other parts being omitted or merely suggested.

FIG. 1 shows a downhole annular barrier 1 to be expanded in an annulus 2 between a well tubular metal structure 3 and a wall 5 of a borehole 6 or another well tubular metal structure 3*a* (the cases part shown in FIG. 7) in a well in order to provide zone isolation between a first zone 101 on one side of the expanded annular barrier 1 having a first pressure P1 and a second zone 102 on the other side of the expanded annular barrier having a second pressure P2 of the borehole 4. The expanded condition of the annular barrier 1 is indicated by dotted lines. The annular barrier comprises a tubular metal part 7, which is mounted as part of the well tubular metal structure 3, e.g. by threaded connections. The tubular metal part 7 has an outer face 4 and an inside 14. The annular barrier further comprises an expandable metal sleeve 8 surrounding the tubular metal part 7 creating an annular space 15 between the inner sleeve face of the expandable metal sleeve and the tubular metal part. The expandable metal sleeve 8 has an inner sleeve face 9 facing the tubular metal part 7 and an outer sleeve face 10 facing the wall 5 of the borehole 6. Each end 12 of the expandable metal sleeve 8 is connected with the tubular metal part 7, e.g. by welding as shown or by connection parts 45B (as shown in FIG. 5A). The annular barrier 1 further comprises a valve unit 40 having an initial position as shown in FIG. 2A and an end position as shown in FIG. 2B. In the initial position, the valve unit 40 provides fluid communication between the annulus and the annular space 15 so that during insertion of the annular barrier into the borehole, the annular space is equalised with the increasing pressure when submerged down into the borehole 6. In the initial position, fluid communication with the inside is prevented so that unintended and premature expansion is avoided. In the end position of the valve unit, fluid communication with the annulus is blocked and fluid communication between the annular barrier 1 and the inside of the tubular metal part/well tubular metal structure 3 is allowed so that intended expansion can be initiated by pressurising the inside of the tubular metal part/well tubular metal structure 3.

The valve unit 40 of FIG. 2A comprises a first aperture 41 in fluid communication with the inside, a second aperture 42 in fluid communication with the annular space, and a third aperture 43 in fluid communication with the annulus. The valve unit further comprises a unit bore 44 having a bore extension and comprising a first bore part 45 having a first inner diameter $ID_1$ and a second bore part 46 having an inner diameter $ID_2$, which is larger than that of the first bore part. The first aperture 41 is arranged in the second bore part 46, and the second aperture 42 and the third aperture 43 are arranged in the first bore part 45 and displaced along the bore extension from the first aperture 41. The valve unit further comprises a unit piston 47 arranged in the unit bore 44. The unit piston 47 comprises a first piston part 48, which is arranged in the first bore part 45 in the initial position and has an outer diameter $OD_1$ substantially corresponding to the inner diameter of the first bore part. The unit piston 47 also comprises a second piston part 49, which is arranged in the second bore part 46 in the initial position and has an outer diameter $OD_2$ substantially corresponding to the inner diameter of the second bore part 46. The valve unit 40 further comprises a shear pin 50 preventing movement of the unit piston 47 until a predetermined pressure in the unit bore 44 is reached, and the unit piston 47 is allowed to move to the end position providing fluid communication between the first aperture 41 and the second aperture 42 and thus fluid communication between the inside of the tubular metal part/well tubular metal structure 3 and the annular barrier. The second aperture 42 is in fluid communication with the third aperture 43 in the initial position so that pressure equalisation between the annular space and the annulus occurs while running the annular barrier into the well.

In FIG. 2A, the valve unit 40 further comprising a spring 51 configured to be compressed after breaking the shear pin 50 by high pressure acting on the second piston part 49 so that when releasing the pressure, the compressed spring 51 forces the unit piston 47 to move to the end position. Thus, in order to move the valve unit 40 from the initial position to the end position an intended decreased of pressure after the high pressure is needed. Hereby, the valve unit does not change position to the end position when running the annular barrier in hole.

Furthermore, it is hereby obtained that the pressure needs to be released to move the unit piston to the end position, and thus the high pressure built up in order to be able to shear the shear pin is not directly transferred to the annular space of the annular barrier as a shock pressure. Hereby, it is ensured that the annular barrier is expanded by a substantially continuously increasing and controlled pressure.

The unit piston 47 has a first piston face 65 at a first piston end 63 at the first piston part 48, and a second piston face 66 at the second piston part 49, the second piston face having a face area, which is larger than a face area of the first piston face in order to move the unit piston towards the first bore end 67. Thus, when the inside of the tubular metal part is pressurised, the fluid enters the first aperture 41 and acts on both the first piston face 65 and the second piston face 66, and since the second piston face 66 is larger than the first piston face 65, the pressure when sufficiently high is capable of breaking the shear pin due to the area difference between the first and second piston faces. Subsequently, the spring 51 moves the unit piston 47 towards the first bore end 67.

The spring arranged in a third bore part 53 has a larger inner diameter than the inner diameter of the second bore part. The unit piston 47 has a third piston part 61 arranged in the third bore part 53 and has an outer diameter larger than the second piston part. The third piston part 61 corresponds to the outer diameter of the spring 51 and by having larger diameter of the third bore, the spring can be as powerful as needed. The unit piston 47 has an intermediate part 62 in between the first piston part 48 and the second piston part 49, and the intermediate part has an outer diameter being smaller than that of both the piston part and the second piston part. The fluid from the bore is then given easier access to the piston face on which it is to act in order to break the shear pin.

In FIGS. 2A and 2B, the valve unit 40 further comprises a locking element 52 adapted to mechanically lock the unit piston 47 when the unit piston is in the end position, blocking the third aperture 43. The locking element 52 is configured to move from the position in FIG. 2A and at least partly radially inwards as shown in FIG. 2B upon movement of the unit piston 47 away from the initial position to prevent the unit piston from returning to the initial position of the unit piston. Thus, the locking element 52 permanently locks the piston in a closed position so that after expansion of the annular barrier, the well tubular metal structure is locked and sealed even though the annular barrier should later break or rupture. The locking element is arranged between the second piston part and the third piston part.

When using a mechanical lock such as the locking element 52 preventing backwards movement of the unit piston, there is no need for a check valve to prevent the return of the unit piston when the pressure inside the annular barrier increases. In this way, the risk of dirt preventing closure of the check valve and the risk that a pressure increase in the annular space of the barrier forces the piston to return and provide fluid communication from the inside of the tubular metal part again are eliminated. In the known solutions using check valves, the expandable metal sleeve has a potential risk of breaking or rupturing when the formation is fracked with colder fluid, such as seawater. By permanently blocking the fluid communication between the annular space and the inside of the well tubular metal structure, the expandable metal sleeve will not undergo such large changes in temperature and pressure which substantially reduces the risk of rupturing.

Sealing elements 64 are arranged in grooves around the first piston part and the second piston part to seal against the inner face of the bore. Hereby, a volume between the first and second end faces 65, 66 is sealed off.

In FIG. 3, the spring 51 is arranged in the third bore part, which is arranged in a second part threading mounted onto the second bore part 49. Hereby, the sping can be made extra long if needed in high pressure wells. The annular barrier further comprises a shear pin assembly 77 having a first opening 16 in fluid communication with the second aperture 42 of the valve unit 40, so that when the unit piston 47 has changed position from the initial position to the end position, the first opening 16 is in fluid communication with the inside of the tubular metal part. The shear pin assembly 77 further comprises a second opening 17 in fluid communication with the annular space of the annular barrier and a third opening 37 in fluid communication with the annulus. The assembly piston 21 has the first position in which the first opening 16 is in fluid communication with the second opening 17, and the second position in which the second opening 17 is in fluid communication with the third opening 37 in order to equalise the pressure between the annular space and the annulus. In the first position, expansion fluid from the second aperture 42 of the valve unit 40 is allowed to flow into the annular space through the first opening 16, and in the second position, fluid connection to the second aperture 42 is blocked preventing expansion fluid from entering the space after expansion. The annular barrier is hereby permanently isolated from the well tubular metal structure after expansion so that a later malfunction of the annular barrier does not interfere with the inside of the well tubular metal structure and thus the production fluid flowing therein. The shear pin assembly 77 has a bore 18 having a bore extension and comprising a first bore part 19 and a second bore part 20. The first bore part 19 has a first inner diameter $ID_{1S}$, and the second bore part 20 has an inner diameter $ID_{2S}$, which is larger than that of the first bore part. The first opening 16 and the second opening 17 are arranged in the first bore part 19 and displaced along the bore extension. The shear pin assembly 77 further comprises a assembly piston 21 arranged in the bore 18. The assembly piston comprises a first piston part 22 having an outer diameter $OD_{P1}$ substantially corresponding to the inner diameter of the first bore part and further comprising a second piston part 23 having an outer diameter $OD_{P2}$ substantially corresponding to the inner diameter of the second bore part. The shear pin assembly further comprises a rupture element 24 preventing movement of the assembly piston 21 until a predetermined pressure in the bore is reached, as then the rupture element is broken and no longer prevents the assembly piston from moving.

By an annular barrier having both a valve unit and a shear pin assembly, an improved annular barrier, which can be expanded in high pressure wells without expanding prematurely is obtained without inducing the risk of collapsing the expandable metal sleeve. Since the valve unit has an initial position in which pressure in the annular space is equalised with the annulus while running the well tubular metal structure in hole, the expandable metal sleeve is no longer in risk of collapsing.

As can be seen from FIG. 3, the shear pin assembly 77 further comprises a locking element 38 adapted to mechanically lock the assembly piston 21 when the assembly piston is in the closed position, therefore blocking the first opening 16. The locking element is configured to move at least partly radially inwards upon movement of the assembly piston away from the initial position, shown in FIG. 5A, to prevent the assembly piston from returning to an initial position of the piston, as shown in FIG. 5B. Thus, the locking element 38 permanently locks the assembly piston in a closed position. The assembly piston has a first piston end at the first piston part having a first piston face 29, and a second piston end at the second piston part having a second piston face 30. The second piston face has a face area, which is larger than a face area of the first piston face. The assembly piston 21 comprises a fluid channel 25 being a through-bore providing fluid communication between the first and second bore parts so that the fluid pressure can act on the larger second piston face area of the second piston part 23 and move the assembly piston to the closed position. The assembly piston 21 has a centre axis arranged in a wall of the tubular metal part or in a wall of a connection part 45B connecting the expandable metal sleeve with the tubular metal part, as shown in FIGS. 5A and 5B. In FIG. 5A, the rupture element is a shear pin engaging the assembly piston. In another embodiment, the rupture element may be a shear disc arranged in the fluid channel or the first bore part for preventing flow past the disc. The first piston part extends partly into the second bore part in first position of the piston and forms an annular space between the piston and an inner wall of the bore providing the fluid communication between the second opening and the third opening.

In FIG. 4, the downhole annular barrier further comprises an anti-collapsing unit 111 comprising an element 201 (shown in FIG. 6) movable between a first unit position (moving to end 36A in FIG. 6) and a second unit position (moving to end 36B in FIG. 6) compressing compliant material 35 (shown in FIG. 6). The anti-collapsing unit has a first inlet 25B, which is in fluid communication with the first zone 101 (shown in FIG. 7) and a second inlet 26B, which is in fluid communication with the second zone 102 (shown in FIG. 7). The anti-collapsing unit has furthermore an outlet 27, which is in fluid communication with the annular space through the shear pin assembly when the assembly piston is in the closed second position, blocking the first opening. The first inlet 25B is in fluid communication with the outlet 27 for equalising the first pressure of the first zone 101 with the annular space in the first unit position, and in the second unit position the second inlet 26B is in fluid communication with the outlet for equalising the second pressure of the second zone with the space pressure.

As shown in FIG. 4, the shear pin assembly 77 has a port A receiving fluid from an inside of the well tubular metal structure 3 through the valve unit 40 after the unit piston has changed position from the initial position to the end position. The valve unit may be fluidly connected to the inside via a screen 44B. The port A is fluidly connected with a port D during expansion (in the first position of the shear pin assembly), causing the expansion fluid within the well tubular metal structure 3 to expand the expandable metal sleeve 8. When the expandable metal sleeve 8 is expanded to abut the wall of the tubular metal structure, the pressure builds up and a shear pin or disc within the shear pin assembly shears closing the fluid connection from port A and opening 28 (as shown in FIG. 5B) and opens the fluid connection between a port B (in fluid communication with the outlet 27) and a port C (in fluid communication with the space 15), so that fluid from the second inlet 26B can be let into the space 15 through the shear pin assembly and through port D. When the first pressure increases in the first zone, fluid from a port E connected with a port I, being the first inlet 25B, presses the element 201 (shown in FIG. 6) to move so that fluid communication is provided between port I and a port H, being the outlet 27, and thus further through ports B and C and into the space 15 through port D. When the second pressure increases in the second zone, the element is forced in the opposite direction, and fluid communication between port G (in fluid communication with the second zone through port F) and port H is provided, i.e. fluid communication between the second inlet 26B and the outlet 27 of the anti-collapsing unit 111, and thus fluid is let into the annular space through ports B, C and D.

In FIG. 5A, the shear pin 50 is intact and extends through the piston and the locking element 38 in form of inserts 43, and in FIG. 5B, the shear pin is sheared, and the piston is allowed to move, and the inserts 43 have moved towards the centre of the bore 18. Depending on the isolation solution required to provide isolation downhole, the rupture element 24 is selected based on the expansion pressure so as to break at a pressure higher than the expansion pressure but lower than the pressure rupturing the expandable metal sleeve or jeopardising the function of other completion components downhole. The bore 18 and the piston 21 may be arranged in a connection part 45B connecting the first ends of the expandable metal sleeve 8 to the tubular metal part 7.

FIG. 7 a cross-sectional view of a downhole system 100 comprising a well tubular metal structure 3 and several annular barriers 1, which have been expanded in an annulus 2 between the well tubular metal structure 3 and an inside face of the borehole 6. Each annular barrier 1 provides zone isolation between a first zone 101 and a second zone 102 of the borehole. The annular barrier 1 has a longitudinal extension, which coincides with the longitudinal extension of the casing/well tubular metal structure 3. The annular barrier 1 comprises the tubular metal part 7, which may be a separate tubular metal part or a casing part for mounting a part of the well tubular metal structure 3. Furthermore, the annular barrier 1 comprises the expandable metal sleeve 1, which surrounds the tubular metal part, and each end of the expandable metal sleeve 8 may be connected with the tubular metal part by means of connection parts. The expandable metal sleeve 8 and the tubular metal part 7 enclose an annular barrier space 15 and as shown in FIG. 1, an expansion opening 28B is provided in the tubular metal part, through which fluid may enter the space 15 via at least the valve unit 40 in order to expand the expandable metal sleeve 8.

As shown in FIG. 1, the expandable metal sleeve 8 comprises sealing elements 116 on the outer face 10 and the projections 133 to abut the inner face of the borehole 6, so that fluid is prevented from flowing freely from the first zone 101 to the second zone 102, as shown in FIG. 7. The sealing elements 116 may comprise a split-ring shaped element 117 having several windings 118 providing back-up for the sealing element 116 during expansion as it unwinds.

As shown in FIG. 7, two annular barriers 1 are often used to isolate a production zone 400. A fracturing valve or inflow valve section 120, also called the frac port or inflow/production valve, is arranged in between the annular barriers 1, so that when the annular barriers 1 have been expanded, the frac port or valve 120 is opened and fluid is let into the formation for creating fractures in the formation to ease the flow of hydrocarbon-containing fluid, such as oil, into the well tubular metal structure 3. The fracturing valve or inflow section 120 may also comprise an inlet section, which may be the same as the frac port. A screen may be arranged so that the fluid is filtered before flowing into the casing.

The expandable metal sleeve may also be crimped onto the tubular metal part, or, if the annular barrier comprises a sleeve, crimped onto the sleeve at its ends. The sleeve is flexible and made of metal or a polymer, such as elastomer.

The expandable metal sleeve may be made from one tubular metal blank, wherein the blank may be made by centrifugal casting or spin casting. Furthermore, grooves for receiving sealing elements in the outer face of the expandable metal sleeve may be provided by machining the blank.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole annular barrier to be expanded in an annulus between a well tubular metal structure and a wall of a borehole or another well tubular metal structure in a well in order to provide zone isolation between a first zone having a first pressure and a second zone having a second pressure of the borehole, the annular barrier comprising:

a tubular metal part adapted to be mounted as part of the well tubular metal structure, the tubular metal part having an outer face and an inside, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, wherein the annular barrier further comprises a valve unit having an initial position and an end position, the valve unit comprising:

a first aperture in fluid communication with the inside, a second aperture in fluid communication with the annular space, a third aperture in fluid communication with the annulus, a unit bore having a bore extension and comprising a first bore part having a first inner diameter and a second bore part having an inner diameter which is larger than that of the first bore part, the first aperture is arranged in the second bore part, and the second aperture and the third aperture are arranged in the first bore part and displaced along the bore extension, a unit piston arranged in the unit bore, the unit piston comprising a first piston part, which is arranged in the first bore part in the initial position and has an outer diameter substantially corresponding to the inner diameter of the first bore part, and the unit piston comprises a second piston part, which is arranged in the second bore part in the initial position and has an outer diameter substantially corresponding to the inner diameter of the second bore part, and a shear pin preventing movement of the unit piston until a predetermined pressure in the bore is reached and the unit piston is allowed to move to the end position providing fluid communication between the first aperture and the second aperture, and wherein the second aperture is in fluid communication with the third aperture in the initial position so that pressure equalisation between the annular space and the annulus occurs while running the annular barrier into the well.

2. A downhole annular barrier according to claim 1, wherein the valve unit further comprises a spring configured to be compressed after breaking the shear pin by pressure acting on the second piston part.

3. A downhole annular barrier according to claim 2, wherein the spring is arranged in a third bore part having a larger inner diameter than the inner diameter of the second bore part.

4. A downhole annular barrier according to claim 3, wherein the unit piston has a third piston part arranged in the third bore part and having an outer dimeter larger than the second piston part.

5. A downhole annular barrier according to claim 1, wherein the valve unit further comprises a locking element adapted to mechanically lock the unit piston when the unit piston is in the end position, blocking the third aperture.

6. A downhole annular barrier according to claim 5, wherein the locking element is configured to move at least partly radially outwards or inwards upon movement of the unit piston away from the initial position to prevent the piston from returning to the initial position of the unit piston.

7. A downhole annular barrier according to claim 1, further comprising a shear pin assembly having a first opening in fluid communication with the second aperture of the valve unit, a second opening in fluid communication with the annular space of the annular barrier and a third opening in fluid communication with the annulus, the shear pin assembly having a first position in which expansion fluid from the second aperture of the valve unit is allowed to flow into the annular space, and a second position in which fluid connection to the second aperture is blocked which prevents expansion fluid from entering the space.

8. A downhole annular barrier according to claim 7, wherein the shear pin assembly has a bore having a bore extension and comprising a first bore part having a first inner diameter and a second bore part having an inner diameter which is larger than that of the first bore part, wherein the first opening and the second opening are arranged in the first bore part and displaced along the bore extension, and the shear pin assembly further comprises:

an assembly piston arranged in the bore, the assembly piston comprising a first piston part having an outer diameter substantially corresponding to the inner diameter of the first bore part and comprising a second piston part having an outer diameter substantially corresponding to the inner diameter of the second bore part, and a rupture element preventing movement of the assembly piston until a predetermined pressure in the bore is reached.

9. A downhole annular barrier according to claim 7, wherein the shear pin assembly further comprises a locking element adapted to mechanically lock the assembly piston when the assembly piston is in the closed position blocking the first opening.

10. A downhole annular barrier according to claim 7, wherein the assembly piston comprises a fluid channel being a through-bore providing fluid communication between the first and second bore parts.

11. A downhole annular barrier according to claim 7, wherein the assembly piston has an initial position in which the first opening is in fluid communication with the second opening, and a closed position in which the second opening is in fluid communication with the third opening in order to equalize the pressure between the annular space and the annulus.

12. A downhole annular barrier according to claim 1, further comprising an anti-collapsing unit comprising an element movable between a first unit position and a second unit position, the anti-collapsing unit having a first inlet, which is in fluid communication with the first zone, and a second inlet, which is in fluid communication with the second zone, and the anti-collapsing unit having an outlet, which is in fluid communication with the annular space through the shear pin assembly when the assembly piston is in the closed position, blocking the first opening.

13. A downhole annular barrier according to claim 12, wherein the first inlet is in fluid communication with the outlet for equalising the first pressure of the first zone with the annular space in the first unit position, and in the second unit position the second inlet is in fluid communication with the outlet for equalising the second pressure of the second zone with the space pressure.

14. A downhole system comprising a well tubular metal structure and an annular barrier according claim 1 in which the tubular metal part of the annular barrier is mounted as part of the well tubular well tubular metal structure.

* * * * *